United States Patent [19]

Abbott et al.

[11] 4,434,220

[45] Feb. 28, 1984

[54] ELECTROPHOTOGRAPHIC TONER AND CARRIER

[75] Inventors: Jerry J. Abbott; Stephen C. Crossan, both of Longmont; Sterritt R. Fuller, Jr., Boulder; Paul D. Jachimiak, Lafayette, all of Colo.

[73] Assignee: International Business Machines Corporation, Armonk, N.Y.

[21] Appl. No.: 398,512

[22] Filed: Jul. 15, 1982

Related U.S. Application Data

[63] Continuation of Ser. No. 960,138, Nov. 13, 1978, abandoned.

[51] Int. Cl.[3] ..... G03G 9/10

[52] U.S. Cl. ..... 430/108; 430/109; 430/111; 525/179; 525/184

[58] Field of Search ..... 430/108, 110; 525/179, 525/184

[56] References Cited

U.S. PATENT DOCUMENTS

| | | | |
|---|---|---|---|
| 3,533,835 | 10/1970 | Hagenbach | 430/110 |
| 3,938,992 | 2/1976 | Jadwin et al. | 430/110 X |
| 4,125,667 | 11/1978 | Jones | 428/403 |

*Primary Examiner*—John D. Welsh
*Attorney, Agent, or Firm*—Francis A. Sirr

[57] ABSTRACT

A developer material comprising toner particles and coated carrier beads for use in developing images in an electrostatographic device is disclosed. The toner particles are initially classified according to a size distribution wherein less than 15% by weight are greater than 16 microns, between 7 and 15% by weight are less than 5 microns, the remainder being from 5 to 16 microns; and wherein the median particle size by weight is from 8 to 12 microns.

The carrier beads have a core with a coating thereon. The coating is a mixed resin system comprising 5 to 55% by weight polytetrafluoroethylene, 5 to 55% by weight fluorinated polyethylene-propylene, and 40% to 80% by weight of a poly(amide-imide) resin which is stable up to at least 600° F., triboelectrically negative (with respect to the herein described toner), nonspalling, essentially nonfriable and dispersible with the other resin components. Also, preferably the coating includes a pigment, such as $TiO_2$, dispersed in the resin system.

More specific ranges of size classification of the toner particles and preferred ranges of resin components are also disclosed.

17 Claims, 3 Drawing Figures

ELECTROPHOTOGRAPHIC TONER AND CARRIER

RELATED APPLICATIONS

This is a continuation, of application Ser. No. 960,138 filed Nov. 13, 1978, now abandoned. U.S. Application Ser. No. 848,173 filed Nov. 3, 1977 entitled Electrophotographic Toner, now abandoned, and whose continuation application Ser. No. 183,701 filed Sept. 3, 1980 is now U.S. Pat. No. 4,284,701.

BACKGROUND OF THE INVENTION

This invention relates generally to a toner/carrier mix for developers in electrophotography, and more particularly to an improved carrier utilized in conjunction with a particular toner size classification.

In electrophotography, a photoconductor is charged and then exposed imagewise to light. In the area of the photoconductor exposed to light, the charge dissipates or decays while the dark areas retain the electrostatic charge.

The difference in the charge levels between the areas exposed to light and the dark areas produces electrical fields therebetween. Thereafter, the resultant latent electrostatic image on the photoconductor is developed by depositing small colored particles, which are known as toner particles, having a charge so as to be directed by the electrical fields to the image areas of the photoconductor to develop the electrostatic image.

A number of means are known for developing the latent electrostatic image by the application of the toner particles. One of these is known as cascade development and is described in U.S. Pat. No. 2,638,552 to Wise. Another means is known as the magnetic brush process. This method is described in U.S. Pat. No. 2,874,063 to Greig.

In each of the cascade and magnetic brush development processes, a two component developer material is utilized. The developer material comprises a mixture of small toner particles and relatively large carrier particles. The toner particles are held on the surfaces of the relatively large carrier particles by, among other factors, electrostatic forces which develop from the contact between the toner and carrier particles producing triboelectric charging of the toner and the carrier to opposite polarities. When the developer material is moved into contact with the latent electrostatic image of the photoconductor, the dislodged toner particles are attracted to the latent image.

The toner and carrier particles of the developer material are specially made and processed so that the toner obtains the correct charge polarity and magnitude of charge to ensure that the toner particles are preferentially attracted to the desired image areas of the photoconductor. The toner particles are then transferred electrostatically to the desired copy sheet, after which the transferred image of toner particles is fused by some combination of heat, pressure or solvent heat and/or pressure to produce the final product of a fused copy of the desired image.

One of the problems encountered is to provide the best possible quality of a final image on the copy sheet. This is generally referred to as copy quality. Copy quality includes such things as image clarity, i.e., clear delineation of lines; uniform darkness of the image areas; background quality, i.e., grayness or lack of it in the background areas; and other somewhat intangible features that go toward making a good "quality" copy.

Other factors that merit consideration in the developing process vis-a-vis toner is the overall utilization of toner per copy. Of course from an economic point of view the less toner used per any given image the better. Also in a system in which nontransferred toner is cleaned from the air by use of a filter, it is important to minimize the amount of nontransferred toner to thereby extend the life of the filter.

Further, when heat fusing is used it is desirable to provide an image that will need the least possible amount of heat to fuse the image. This is important not only from an energy point of view, but also with more rapid heat transfer by the toner, the fusing time or temperature can be reduced.

Said application Ser. No. 848,173 discloses a toner classification which to a large extent overcomes these problems. However, there are additional problems encountered when utilizing this improved toner with conventional carrier beads having polytetrafluoroethylene coating thereon. One particular problem encountered is what is known as fluorocarbon contamination. This is characterized by the transfer of the polytetrafluoroethylene from the carrier coating onto the surface of the toner. Such transfer or smearing causes a detrimental alteration of the triboelectric properties of the surface of the toner particles with a resultant deterioration in the performance of the toner.

Additionally, the pure polytetrafluoroethylene coating on the carrier has a slow, but still rather significant wear rate. Hence, while the polytetrafluoroethylene coated carrier is quite long lasting with respect to other conventional coatings, nevertheless it does wear off after several hundred thousand copies have been made.

Thus there is a need for a carrier coating for use in conjunction with the improved toner that reduces fluorocarbon contamination and is extremely long lasting.

SUMMARY OF THE INVENTION

According to the present invention, an improved developer comprised of a toner-carrier mix is provided. The carrier component has a ferromagnetic core with a mixed resin coating thereon. The coating comprises broadly about 5% to about 55% by weight polytetrafluoroethylene (PTFE), about 5% to about 55% fluorinated ethylene-propylene (FEP) and about 40% to about 80% by weight poly(amide-imide) (PAI). Preferably the coating also includes a pigment, e.g., $TiO_2$. The toner component is a powder having a size distribution in which less than 15% by weight is greater than 16 microns, between about 7% and about 15% by weight is less than 5 microns, the remainder being between from about 5 to about 16 microns. The madian particle size by weight is from 8 to 12 microns.

DESCRIPTION OF THE PREFERRED EMBODIMENTS

According to the present invention, an improved developer for electrophotographic copying devices is provided which employs the improved toner of application serial number 848,173, together with carrier beads, having a mixed resin coating of polytetrafluoroethylene, fluorinated polyethylene-propylene, and a poly(amide-imide) resin. The carrier coating also preferably contains a pigment such as $TiO_2$ particles to control triboelectric charge.

Figure 1:
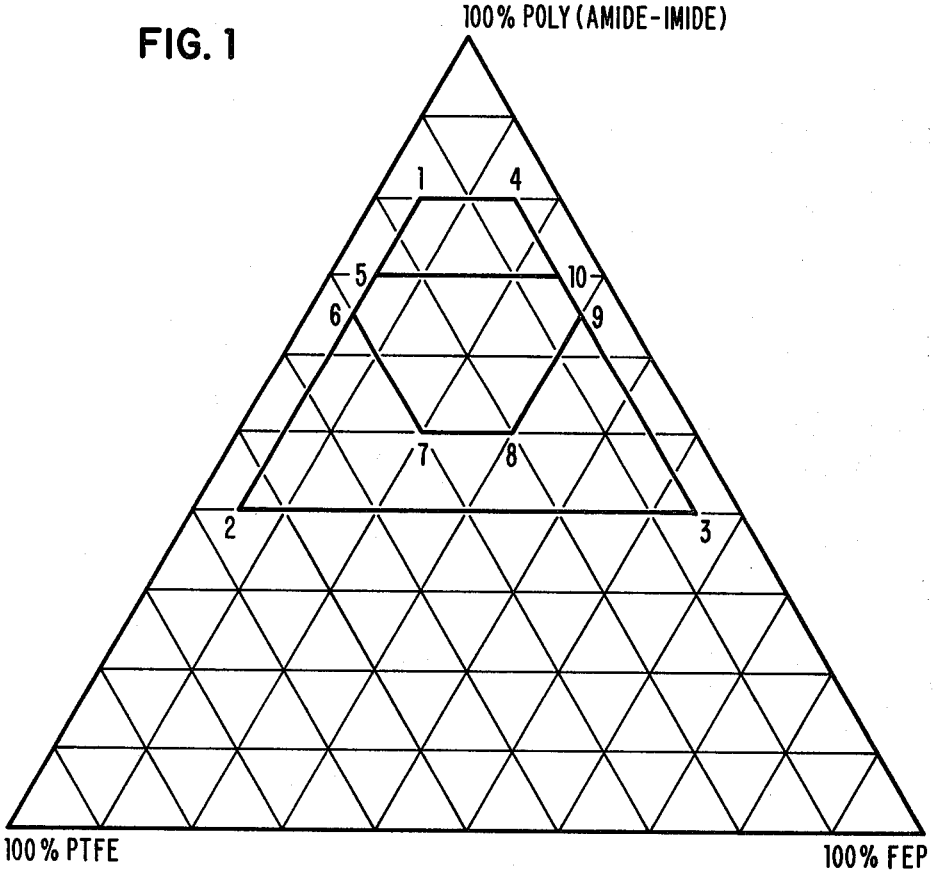
FIG. 1 is a graph showing the broad and preferred composition of a carrier coating according to this invention.

Turning now to the carrier component of the developer, a core material is provided, preferably of a size of from about 50 to 500 microns in diameter, which must be a magnetic material if the developer is to be used with magnetic brush development. A coating comprised of a three part mixed resin system is applied to the core to form the carrier beads. The resin system is comprised of polytetrafluoroethylene, fluorinated polyethylene-propylene, and poly(amide-imide) with the proportions of each of these resins controlled to provide a superior carrier of extremely long life, with a very low propensity for fluorocarbon contamination of the toner particles. FIG. 1 show graphically the broad, preferred, and optimum percentage ranges of the components of the resin system. Broadly, the composition should be within the boundaries set by the line between points 1, 2, 3 and 4. This area represents a composition which has from about 5 to about 55% by weight of polytetrafluoroethylene, from about 5 to about 55% weight of fluorinated polyethylene-propylene, and from about 40% to about 80% by weight of a poly(amide-imide) resin. The fluorinated polyethylene-propylene is a copolymer of tetrafluoroethylene (TFE) and hexafluoropropylene (HFP). Typically there is about 80–85% TFE and 15–20% HFP, preferably about 80% of TFE, 20% HFP. However, these proportions may vary somewhat.

The poly(amide-imide) resin is characterized in that it is stable up to 600° F., triboelectrically negative (with respect to the herein described toner), essentially nonspalling, essentially nonwearing, essentially nonfriable, and dispersible with the other resin components. Typical of such a poly(amide-imide) resin is a copolymer of trimellitic anhydride and an organic bis-amine, e.g., 4,4'-bis-amino-dephenylmethane. Such a polymer typically has a molecular weight in the range of 15,000 to 30,000, preferably 20,000 to 25,000. However, other poly(amide-imide) resins could be used. For example, pyromellitic anhydride or other similar anhydrides either individually or in combination can be used with the above or other bisamines, preferably aromatic bisamines. Examples of these poly(amide-imide) resins are described in E. I. duPont U.S. Pat. No. 3,179,614.

Even more particularly, the preferred ranges of the components of the resin system should fall within the bounds of the line connecting points 5, 6, 7, 8, 9 and 10 of the diagram. This represents a composition of from about 5 to about 30% by weight polytetrafluoroethylene, from about 5 to about 30% by weight fluorinated polyethylene-propylene and from about 50% to about 70% by weight of poly(amide-imide). The optimum composition is about 20% by weight polytetrafluoroethylene, about 20% by weight fluoronatedethylene-propylene, and about 60% by weight poly(amide-imide).

With respect to the criticality of these ranges, it has been found that with 100% polytetrafluoroethylene, (which is conventional prior art), there is a substantial tendency for fluorocarbon contamination of the toner particles i.e., the carrier coating material transfers onto the surface of the toner particles altering the triboelectric properties of the toner particles, and hence contributing to deterioration in the performance of the toner. The addition of the poly(amide-imide) resin alone to polytetrafluoroethylene does not adequately reduce such contamination tendencies of the coating, and, in fact, when only minor portions of the poly(amide-imide) are used alone with polytetrafluoroethylene, there is very poor adhesion of the coating under shear. The use of fluorinated polyethylene-propylene in combination with poly(amide-imide) resin alone provides a coating that is highly susceptible to filmed-on-toner. This is a condition in which the toner material (a methyl methacrylate/n-butyl methacrylate based system) tends to transfer, or smear onto the surface of the carrier coating. This impairs the ability of the carrier to electrostatically hold toner particles, thus causing a deterioration in the performance of the developer. Poly (amide-imide) alone has a propensity for filmed-on-toner, as well as having too high a surface electrical charge. Conversely, if there is less than about 40% poly(amide-imide) the charge is too low. Further in this less than 40% range of poly(amide-imide) with a preponderance of polytetrafluoroethylene there is a propensity for fluorocarbon contamination of toner; and with a preponderance of fluorinated polyethylene propylene there is a propensity for filmed-on-toner.

Thus, in order to obtain the required developer performance, it is necessary to utilize all three resins in the indicated balance. For charge control and control of filmed-on-toner, there must be between 40% and 80% poly(amide-imide). There must be at least 5% fluorinated polyethylene propylene to sufficiently reduce the propensity for fluorocarbon contamination, and at least 5% polytetrafluoroethylene to adequately reduce the propensity for filmed-on-toner. Within this rangge, the poly(amide-imide) provides a component which is so wear resistant that the coating is essentially nonwearing.

Within the even narrower ranges, better control of these properties is obtained and optimal control is obtained at the optimum values.

It is also desirable for better control of the triboelectric charge to add a pigment to the resin. Preferably, this is $TiO_2$, and is added in an amount of from about 3% to 15% by weight (of the total coating weight). Preferably, the $TiO_2$ is from 7% to 9% and optimally about 8%. As is well known in the art, $TiO_2$ also can serve the purpose of activating sensors to replenish toner when the toner supply is low. The improved carrier coating of this invention provides outstandingly improved results in copy quality when used with the toner described in said application Ser. No. 848,173. Such toner is classified to have a particle size distribution of less than 15% by weight greater than 16 microns in size, from 7% to 15% by weight less than 5 microns, the remainder being 5 to 16 microns in size, the particle median size by weight being 8 to 12 microns. Preferably, the distribution is less than 2% by weight greater than 16 microns, 9% to 15% by weight less than 5 microns in size, the median particle size by weight being 8.5 to 9.5 microns. When the developer mix has been equilibrated after a break-in period (normally after about 10,000 copies), the toner particles should have a size distribution of 15% to 30% by weight less than 5 microns, less than 12% by weight greater than 16 microns, the remainder being from 5 to 16 microns, the median particle size by weight being between 6.5 and 9.5 microns.

Table I shows the improved results of the combination of the improved toner and carrier of this invention over the conventional polytetrafluoroethylene coated carrier and conventional toner. Example I represents the prior art toner with pure polytetrafluoroethylene coating carrier, and Examples II, III and IV represent toner and carrier according to this invention. Table II gives the size distribution of the toner and the nominal coating composition of the carrier beads. Conventional recirculating magnetic brush development techniques were utilized in performing the tests.

TABLE I

| Example | I | II | III | IV |
|---|---|---|---|---|
| Optical Density | .95 | 1.15 | 1.15 | 1.15 |
| % Background | 1.20 | 0.5 | 0.7 | 0.9 |
| Recycle Rate per copy (mg) | 30.0 | 7.0 | 10.0 | 15.0 |
| Toner Yield copies/lb. | 14,000 | 32,000 | 29,000 | 27,000 |
| Fuse Quality of Offset Masters | Unacceptable | Superior | Superior | Superior |

TABLE II

| | I | | II | | III | | IV | |
|---|---|---|---|---|---|---|---|---|
| Example | Virgin Toner | Bin Mix | Virgin Toner | Bin Mix | Virgin Toner | Bin Mix | Virgin Toner | Bin Mix |
| Median Particle Size by Weight | 13.5 | 11.0μ | 9 | 7 | 10 | 8 | 10 | 8 |
| Percent by Weight, less than 5 microns | .8 | 14.0% | 11 | 25 | 12 | 18 | 9 | 17 |
| Percent by Weight, greater than 16 microns | 30.0 | 24.0% | .1 | .3 | 6 | 5 | 15 | 11 |
| Carrier Coating Ratio, PTFE/FEP*/PAI/$TiO_2$ | | 100% PTFE | 16/17/57/9 | | 20/9/62/9 | | 20/9/62/9 | |

*Fluorinate - polyethylene-propylene

Figure 2:
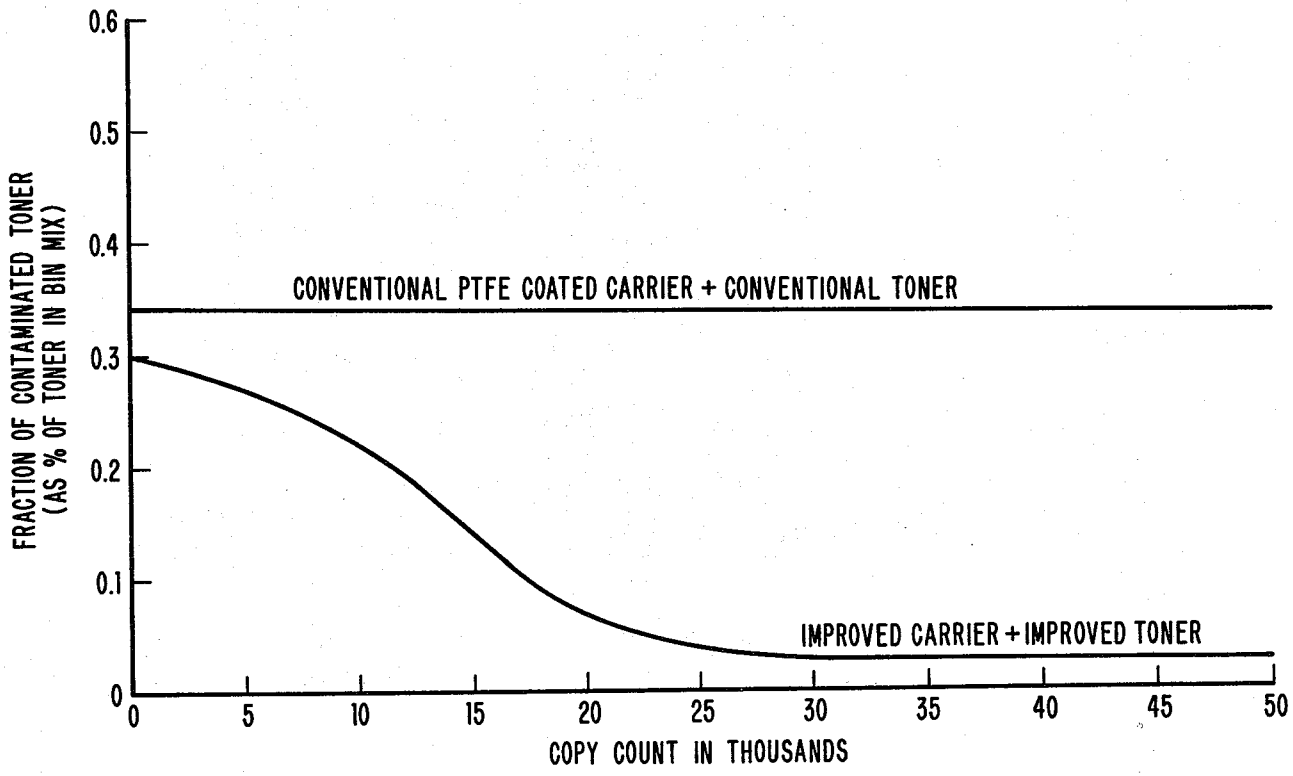
FIG. 2 is a graphical representation of the percent contaminated toner in both a conventional carrier-toner system and the improved carrier-toner system as a function of copies produced.

Table I shows, in terms of copy results, the superiority of the combination of the improved toner and coated carrier of the present invention. The reasons for such improvements are not completely understood. However, it is believed that the very long lasting quality of the carrier coating imparted by the poly(amide-imide) resin together with the very low propensity for fluorocarbon contamination imparted by the mixed fluorinated polyethylene propylene/polytetrafluoroethylene resins in the system contribute substantially to such improved results. A comparison of the fraction of contaminated toner utilizing conventional toner (similar to that of Example I) and conventional carrier having pure polytetrafluoroethylene coating with toner and carrier (similar to that described in Example IV) according to this invention is shown in graph form in FIG. 2. In this figure the fraction of fluorocarbon-contaminated toner is plotted against copy count. As can be seen, there is progressively less contaminated toner with the present invention whereas with the conventional prior art toner/carrier, the amount of contaminated toner stays the same and at a level which is significantly higher than that with the improved toner and carrier coating of this invention. This significant reduction in contaminated toner contributes significantly to the improved results noted in Table I supra.

The percent contaminated toner is determined by the following procedure:

1. 3 to 5 ml of an appropriate liquid or solution such as 0.1% Triton X-100 in deionized water is poured into a shallow dish.
2. A known weight of toner-carrier mix (e.g., 0.25 gram) is poured onto the surface of the liquid.
3. The carrier is allowed to wet and sink, leaving the toner on the liquid surface.
4. The solution is then agitated from the bottom of the dish by stirring the carrier, e.g., with a magnet. Stirring is continued until a uniform color is achieved.
5. The carrier is held down with a magnet and the toner and solution are poured into a small mouth vial filled to within about 5 mm of the top with the same liquid solution. Care must be taken to minimize the presence of bubbles.
6. The vial is then carefully filled so that the surface tension will cause the liquid surface to extend above the top of the vial.
7. A preweighed, rigid piece of plastic is placed over the top of the vial so that the solution wets it and any floating toner adheres to it. The piece of plastic is removed and dried, then reweighed.
8. The percent of contaminated toner is equal to the weight gain of the piece of plastic divided by the product of the mix weight and the toner concentration expressed as a fraction.

Figure 3:
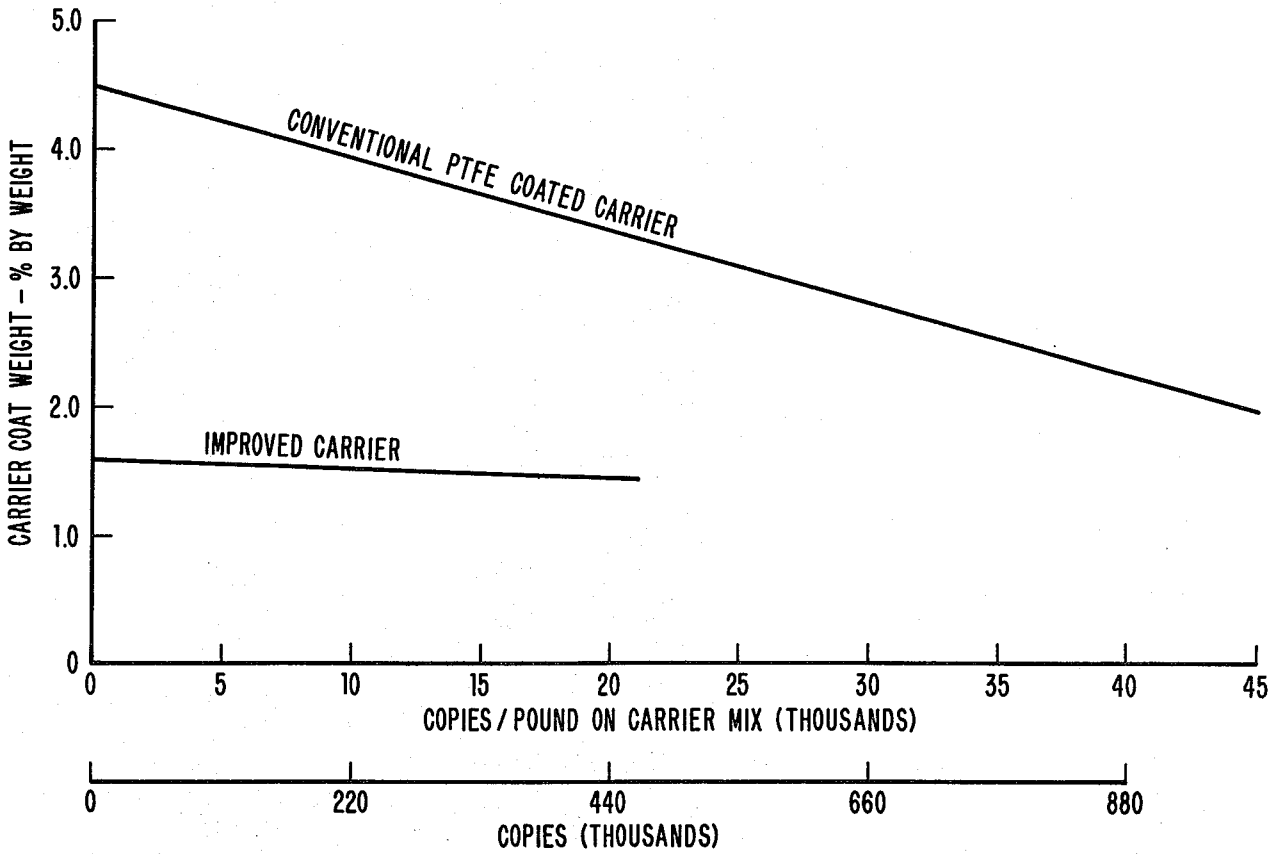
FIG. 3 is a graphical representation of the weight loss from both a conventional carrier and the improved carrier of this invention as a function of copies produced and copies/pound of mix.

FIG. 3 is a graph on which is plotted the weight of the coating on the carrier as a function of numbers of copies produced. With the conventional prior art toner/carrier (pure polytetrafluoroethylene coating) there is a progressive significant loss of carrier coating. However, with the carrier of the present invention (which in this example is nominally the composition of Example IV) there is a very, very slow loss of carrier coating which indeed can be characterized as an essentially nonwearing coating, the nonwearing property being contributed by the poly(amide-imide) resin.

Experiments were also conducted to compare the improved carrier coating and conventional prior art toner with the improved carrier coating and the improved toner classification. These results are shown in Table III below. Example V utilized prior art toner and example VI the improved toner of this invention.

TABLE III

| Example | V | IV | Standard Toner & Carrier For Comparison |
|---|---|---|---|
| Optical Density | 0.98 | 0.95 | .95 |
| Background | 0.74 | 0.58 | 1.20 |
| Cleaner Through-put mg per copy | 62 | 12 | 30.0 |
| Toner Yield Copies/lb | 22,000 | 34,000 | 14,000 |
| Development | Good | Superior | |
| Fuse Quality | Good | Superior | Unacceptable |

In the above Example V, the toner bin mix (equilibrated) distribution was as follows:

| | |
|---|---|
| Medium size (by weight) | 13.5 microns |
| % by weight less than 5 microns | 0.8 |
| % by weight greater than 16 microns | 30 |

In Example VI, the bin mix distribution was as follows:

| | |
|---|---|
| Medium size (by weight) | 8.5 microns |
| % by weight less than 5 microns | 7.1 |
| % by weight greater than 16 microns | 1 |

In each case, the carrier was coated to a nominal 60/20/20 ratio poly(amide-imide)/polytetrafluoroethylene/fluorinated polyethylene propylene with about 9% $TiO_2$ added.

As can be seen, the background, cleaner throughput, yield, development, and fuse quality are all substantially improved with the toner/carrier combination of this invention.

The reason why the particular carrier coating works so well with the toner described in application Ser. No. 848,173, as compared to the prior art toner is not completely understood. However, it is believed that even the small propensity of the coating of this invention to contaminate toner with fluorocarbon is very significant in the case of the prior art toner wherein there is a very significant percentage of large particles (i.e., greater than 16 microns). The charge to mass ratio in these particles is quite low, and is borderline to making acceptable copy quality. Hence, even a slight amount of contamination may reduce this charge significantly to cause poor copy performance. In any event, the combination of the improved poly(amide-imide)/polytetrafluoroethylene/fluorinated polyethylene propylene system in combination with toner as described in said application Ser. No. 848,173 provides outstanding improvement to copier performance.

What is claimed is:

1. A developer mix of toner particles and carrier beads for use in electrostatic copying having magnetic brush development, comprising;

toner particles having a size distribution wherein less than 15% by weight are greater than 16 microns in size, from 7% to 15% by weight are less than 5 microns in size, the remainder being from 5 to 16 microns in size, the particles median size by weight being 8 to 12 microns in size; and carrier beads having a magnetic core and a coating on said core, said coating having a resin system comprised of about 16% to about 20% by weight of polytetrafluoroethylene, about 9% to about 20% by weight fluorinated polyethylene-propylene, and about 59% to about 62% by weight of a poly (amide-imide) which is stable up to at least 600° F., triboelectrically negative, nonspalling, essentially nonwearing, dispersible with respect to the other resin components, and essentially nonfriable.

2. The invention as defined in claim 1 wherein there is about 20% polytetrafluoroethylene, about 20% fluorinated polyethylene-propylene, and about 60% poly(amide-imide).

3. The invention as defined in claim 1 wherein there is incorporated in the resin system a pigment to modify the triboelectric properties of the resin.

4. The invention as defined in claim 3 wherein the pigment is $TiO_2$.

5. The invention as defined in claim 4 wherein there is about 9% $TiO_2$ by weight.

6. The invention as defined in claim 1 wherein said poly(amide-imide) resin is a copolymer of at least one anhydride and an organic bis-amine.

7. The invention as defined in claim 6 wherein the anhydride includes at least one from the group trimellitic anhydride and pyromellitic anhydride.

8. The invention as defined in claim 7 wherein the bis-amine is 4,4'-bis-amino-diphenylmethane.

9. An equilibrated developer mix of toner particles and carrier beads for use in electrostatic copying having magnetic brush development, comprising;

toner particles having a size distribution wherein less than 12% by weight are greater than 16 microns in size, from 15% to 30% by weight are less than 5 microns in size, the remainder being from 5 to 16 microns in size, the particles median size by weight being 6.5 to 9.5 microns in size;

carrier beads having a magnetic core and a coating on said core, said coating having a resin system comprised of about 16% to about 20% by weight of polytetrafluoroethylene, about 9% to about 20% by weight fluorinated polyethylene-propylene, and about 59% to about 62% by weight of a poly(amide-imide) which is stable up to at least 600° F., triboelectrically negative (with respect to the herein described toner), nonspalling, essentially nonwearing, dispersible with respect to the other resin components, and essentially nonfriable.

10. The invention as defined in claim 9 wherein there is about 20% polytetrafluoroethylene, about 20% fluorinated polyethylene-propylene, and about 60% poly(amide-imide).

11. The invention as defined in claim 9 wherein there is incorporated in the resin system a pigment to modify the triboelectric properties of the resin.

12. The invention as defined in claim 11 wherein the pigment is $TiO_2$.

13. The invention as defined in claim 12 wherein there is about 9% $TiO_2$ by weight.

14. The invention as defined in claim 10 wherein there is about 9% $TiO_2$ by weight incorporated in the resin system.

15. The invention as defined in claim 9 wherein said poly(amide-imide) resin is a copolymer of at least one anhydride and an organic bis-amine.

16. The invention as defined in claim 9 wherein the anhydride includes at least one from the group trimellitic anhydride and pyromellitic anhydride.

17. The invention as defined in claim 16 wherein the bis-amine is 4,4'-bis-amino-diphenylmethane.

* * * * *